US007786362B1

(12) United States Patent
Whetstine

(10) Patent No.: US 7,786,362 B1
(45) Date of Patent: Aug. 31, 2010

(54) PICK FOR STRINGED MUSICAL INSTRUMENTS

(76) Inventor: Frank Whetstine, 210 W. Main, Suite 5, Arlington, TX (US) 76010

( * ) Notice: Subject to any disclaimer, the term of this patent is extended or adjusted under 35 U.S.C. 154(b) by 0 days.

(21) Appl. No.: 12/537,633

(22) Filed: Aug. 7, 2009

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS

| | | | | |
|---|---|---|---|---|
| 3,735,663 A | | 5/1973 | Cowell, Sr. | 84/322 |
| 4,347,773 A | | 9/1982 | Zook | 84/332 |
| 4,625,615 A | | 12/1986 | Lukehart | 84/322 |
| 5,509,341 A | * | 4/1996 | Dunlop | 84/322 |
| 5,973,243 A | | 10/1999 | Christenson | 84/322 |
| 6,130,374 A | | 10/2000 | Polido | 84/322 |
| D588,628 S | | 3/2009 | Key | D17/20 |
| 2009/0217797 A1 | | 9/2009 | Cheok | 84/322 |

* cited by examiner

*Primary Examiner*—Kimberly R Lockett
(74) *Attorney, Agent, or Firm*—Charles D. Gunter, Jr.

(57) ABSTRACT

A musician's pick having a pick body made up of both a pick portion and a gripping portion. The pick portion and gripping portion are angularly oriented with respect to each other in a predetermined manner. The predetermined angular orientation between the pick portion and the grip portion of the pick allows the pick portion to engage the strings of an instrument being played in a generally perpendicular relation despite the normal, parallel relation between the strings and the longitudinal axis of the musician's thumb.

9 Claims, 3 Drawing Sheets

PICK FOR STRINGED MUSICAL INSTRUMENTS

BACKGROUND OF THE INVENTION

1. Field of the Invention

The present invention relates generally to a musician's pick or plectrum and, more particularly, to a pick that is used by musicians for playing stringed instruments that are to be plucked or strummed such as guitars, banjos, mandolins, and the like.

2. Description of the Prior Art

A wide variety of pick or plectrum designs are shown in the prior art that are used for playing stringed instruments. In the typical prior art design, the pick is normally formed out of a convenient resilient plastic sheet material, or like composition. In the case of a flat pick, the inner or grip portion of the pick is typically characterized by a relatively large radius inner edge extremity, and by side edges which converge downwardly to a pointed, relatively small radius pick portion for engagement with the stings of the instrument being played, such as an acoustic or electric guitar. In the case of a thumb pick, the pick body includes a thumb engaging portion for coupling the pick to the user's thumb. The pick portion of the pick body extends outwardly from a bottom surface of the thumb engaging portion, generally at a right angle to the thumb. This places the pick portion of the pick body in a plane which is generally parallel to the plane of the strings being struck. In the case of the flat pick, the inner of grip portion of the pick body is usually grasped between the thumb and forefinger of the user and the pick portion of the pick body is again positioned in a plane which is generally parallel to the plane of the strings being struck.

The teachings of the prior art have recognized that the tonal quality of a stringed instrument, such as a guitar, is significantly affected by the orientation of the plane of the pick portion relative to the strings. However, the prior art references generally teach that optimum tonal quality is achieved when the string is strummed or picked with the plane of the pick portion generally parallel to the axis of the string, rather than the picking the string with the edge of the pick. In actuality, the normal playing position of a musician playing, for example an electric guitar, locates the axis of the forearm at an angle relative to the axes of the strings, the angle varying somewhat according to the physical characteristics of the musician. This also places the plane of the pick at the same approximate angle relative to the strings due to the fact that the plane of the pick when held naturally and comfortably between the thumb and forefinger, will normally be approximately parallel to the longitudinal axis of the musician's forearm.

As a result of these considerations, certain of the prior art pick designs provide for a twist in the overall pick contour. However, the shape or contour of the prior art picks, as well as the provision of a twist or contour in the profile of the pick, has generally been a feature directed toward increasing the comfort in the gripping action by the user when playing the stringed instrument, for example, to locate the axis of the forearm at a lesser relative angle to the axes of the strings of the instrument.

These variations in pick design were, therefore, often an attempt to keep the plane of the pick portion of the pick body in a plane generally parallel to the plane of the strings being struck. As a result of the foregoing discussion, it will be appreciated that the prior art generally teaches away from the use of a pick which orients the pick portion of the pick body at a right angle to the grip portion of the pick body. Some of the prior art designs have altered the plane of the pick portion of the pick body from being completely parallel to the plane of the string being plucked or strummed. However, as has been mentioned, this was generally done to increase the comfort level of the user so that the user could hold the pick in a relaxed manner while maintaining the desired orientation of the pick. In other words, many of the prior art designs were intended to eliminate the need for the user to cock the wrist and experience fatigue that typically accompanies such an unnatural or cramped position. In addition, it has been found that cocking of the wrist tends to make it more difficult to rapidly strum the strings when playing music having a fast tempo, as well as other situations.

U.S. Pat. No. 3,735,663 shows a prior art pick design in which the strumming tip is supported on the end of a "handle portion." The strumming tip apparently continues to be arranged parallel to the guitar strings, however.

U.S. Pat. No. 4,347,773 apparently contemplates altering the plane of the pick from its usual general parallel alignment with the strings. The apparent "optimum angulation" taught by this reference is 20° (column 5, lines 39-40). The reference does not appear to contemplate a 90° angle, however.

U.S. Pat. No. 5,509,341 shows a thumb pick that has an intermediate portion which is formed so that the pick portion is rotated to a pre-determined angular relationship of the pick plane relative to the thumb plane (Abstract). However, it does not appear from the drawings or discussion to contemplate a 90° angle.

U.S. Pat. No. 6,130,374 shows an unconventional "speed pick" having a frusto-conic al end which converges to a point. In a sense, this pick could be said to have an infinite angle with respect to the plane of the strings.

U.S. Pat. No. 5,973,243 shows a pick with a pick portion attached to a ring portion. The pick portion projects from the ring at a selected angle from the plane of the ring portion. FIGS. 4-8 show various configurations of the pick portion of the device. However, as discussed at column 3, lines 47-54, the preferred angularity between the pick portion and ring is about 22°.

Despite the above advances in pick designs, a need continues to exist for further improvements in the design of a pick for a musical instrument which provides a novel orientation of the pick portion of the pick body in order to provide a different tonal quality to the instrument being played while providing a relaxed playing stance or position.

SUMMARY OF THE INVENTION

The present invention has as one object to provide a novel pick design which may be readily formed of a desired size and curvature to be comfortably received in a musician's hand and which provides a pick portion of the pick body which is generally oriented downwardly at a predetermined angle with respect to the grip portion of the pick body, so that the pick portion tends to strike the strings of the instrument being played at a predetermined angular orientation.

A still further object of this invention is the provision of a pick which may be easily formed from readily available materials, such as a resilient, thin plastic sheet material.

A still further object of this invention is to provide a one-piece musical pick which may be molded or otherwise manually formed into the previously described angular orientation to suit the needs and desires of musicians desiring to utilize this unusual pick orientation.

The improved musician's pick of the invention includes a pick body having a gripping portion lying generally within a grip plane and adapted to be gripped between the thumb and forefinger of a musician with the grip plane being generally parallel to the longitudinal axis of the musician's thumb. A pick portion of the pick body extend outwardly from the gripping portion and terminates in an outer extent which defines a pick plane. The pick portion has a predetermined length which is adapted to engage an instrument string at a predetermined depth when the gripping portion is gripped between the musician's thumb and forefinger.

In the design of the pick of the invention, an outer extent of the pick portion of the pick body is angled downwardly with respect to the gripping portion of the pick body such that the pick plane is angularly inclined at an angle greater than about 30° with respect to the gripping plane. This enables orientation of the pick portion of the pick body at a near right angle relative to the plane of a string being struck while maintaining a near parallel orientation between the longitudinal axis of the musician's forearm and the string.

The pick of the invention can be formed of any number of convenient materials, preferably from a synthetic, thermoplastic composition. The pick can take the form of a thumb pick where the gripping portion of the pick body includes a ring-shaped region for at least partly encircling the thumb of the user. Alternatively, the pick can take the form of a traditional flat pick where the pick portion of the pick body is formed as previously described.

In a particularly preferred form of the invention, the pick portion of the pick body is angled downwardly at an angle approaching about 45-50° or greater with respect to the gripping plane of the pick body, thereby enabling orientation of the pick portion of the pick body at an angle approaching a right angle relative to the plane of the string being struck. The pick body can include an intermediate portion of varying length between the gripping portion and the pick portion, and wherein the length of the intermediate portion determines the degree at which the pick plane is angularly inclined relative to the gripping plane of the pick.

In the method of playing a stringed musical instrument using the musician's pick of the invention, a pick is provided as previously described with a pick body including a gripping portion lying generally within a grip plane and adapted to be gripped between the thumb and forefinger of a musician with the grip plane being generally parallel to the longitudinal axis of the musician's thumb. A pick portion on the pick body is formed which extends outwardly from the gripping portion and which terminates in an outer extent which defines a pick plane. The outer extent of the pick portion of the pick body is angled downwardly with respect to the gripping portion of the pick body such that the pick plane is angularly inclined at an angle greater than about 30° with respect to the gripping plane, as previously described. The musical instrument is then played by striking the strings with the pick with the pick portion of the pick body being approximately perpendicular to the plane of the strings and to the plane of the musician's thumb while maintaining a near parallel orientation between the longitudinal axis of the musician's forearm and the string.

Additional objects, features and advantages will be apparent in the written description which follows.

DETAILED DESCRIPTION OF THE INVENTION

The preferred version of the invention presented in the following written description and the various features and advantageous details thereof are explained more fully with reference to the non-limiting examples included in the accompanying drawings and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

The present invention relates to a musician's pick for playing a stringed instrument such as an electric or acoustical guitar. The guitar includes the usual plurality of strings (e.g., 12, 14, 16, in FIGS. 8 and 9) which extend generally parallel to longitudinal axis 18 of guitar 12. Although the present invention will be described in connection with a guitar (20 in FIG. 8), the pick of the invention may be equally adapted for use in playing various other types of guitars and stringed instruments, such as solid body electric guitars, classical or Spanish guitars, steel string acoustic guitars, and solid body bass guitars, to name a few. Picks that have been used for instruments of this type are sometimes referred to as "plectra" and, in the case of a flat pick, are normally grasped by the musician between the thumb and forefinger.

As described in the Background of the Invention, most players of stringed musical instruments, such as the guitar, hold a flat pick so that the pick portion of the pick strikes the string in a plane generally parallel to the string. As a matter of fact, the musician will often go to a great deal of effort to maintain a desired orientation of the pick relative to the string being struck so that it is difficult to hold the pick in a relaxed manner with the result sometimes being a loss of tonal quality which results when the side edge of the pick engages the strings. Alternatively, the musician will attempt to cock the wrist and consequently experience the fatigue which typically accompanies this cramped position. In addition, it has been found that, in many cases, cocking of the wrist tends to make it more difficult to rapidly strum the strings when playing music having a fast tempo.

The present invention deals with the provision of a unique angular relation between the grip portion of a musician's pick and the pick portion thereof which gives a unique tonal quality to the instrument being played and which also makes it much easier to rapidly strum the strings since normal rotation of the hand about the axis of the forearm occurs without any unnatural bending, cocking, or awkward orientation of the hand or forearm.

Figure 1:
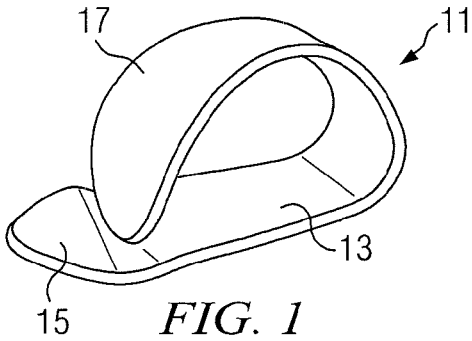
FIG. 1 (PRIOR ART)
FIG. 1 is a view of a prior art pick for a musical instrument in which the pick portion of the pick body lies in a plane generally parallel to the plane of the string of the instrument being struck.
Figure 2:
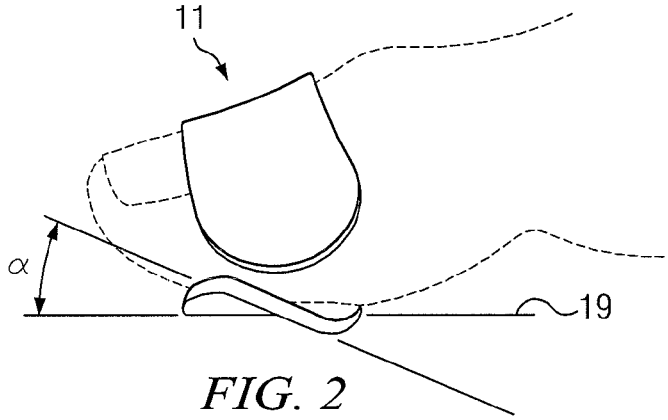
FIG. 2 (PRIOR ART)
FIG. 2 is another view of the prior art pick of FIG. 1 showing the pick portion of the pick body striking a string of musical instrument.

Turning now to FIGS. 1 and 2, there is illustrated a prior art musician's pick, designated generally as 11. The pick 11 is made up of a pick body having a gripping portion (generally at 13) and an outwardly extending pick portion 15. The particular pick design shown in FIG. 1 is a thumb pick and thus has a ring-shaped portion 17 which encircles the musician's thumb in use. The particular pick illustrated in FIGS. 1 and 2 is sometimes referred to as the "Zook" pick and is described generally in issued U.S. Pat. No. 4,347,773. As was generally true with respect to this and other prior art pick designs, the pick portion 15 of the pick body was designed to strike the string of the musical instrument in a plane which was generally parallel to the plane of the string (indicated as 19 in FIG. 2). In the case of the Zook pick illustrated, the pick portion 15 of the pick body was actually angled upwardly at some angle "$\propto$" with respect to the plane of the string 19 so that the musician could more comfortably grasp the pick while still striking the plane of the string approximately parallel thereto.

Figure 3:
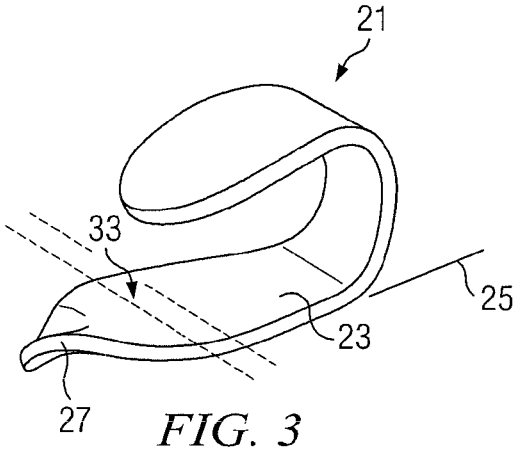
FIG. 3 is a perspective view of a thumb pick which embodies the improved design for a pick for a musical instrument of the invention.
Figure 4:
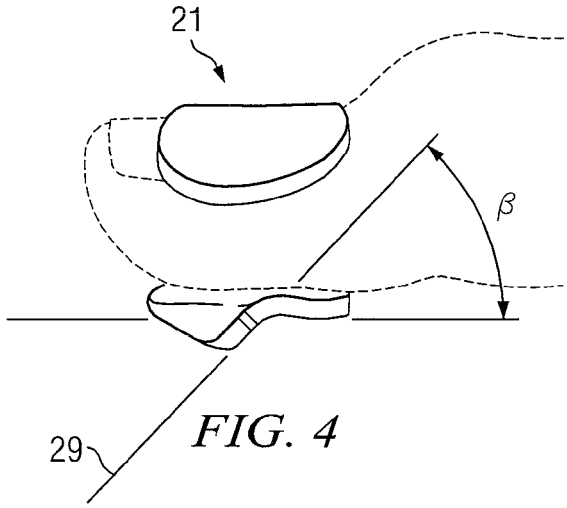
FIG. 4 is a another view of the pick of the invention in place on a musician's thumb and showing the angle between the pick portion of the pick body and the string of the musical instrument being struck.

FIGS. 3 and 4 illustrate the improved pick design of the invention. The pick of the invention, designated generally as 21, has a pick body which includes a gripping portion 23 lying generally in a grip plane 25 and adapted to be gripped between the thumb and forefinger of a musician with the grip plane being generally parallel to the longitudinal axis of the musician's thumb.

A pick portion 27 extends outwardly from the gripping portion 23 and terminates in an outer extent which defines a pick plane (generally at 29 in FIG. 4). The pick portion will have a predetermined length which is adapted to engage an instrument string at a predetermined depth when the gripping portion is gripped between the musician's thumb and forefinger. It will be appreciated with respect to FIG. 4, that the outer extent of the pick portion 27 of the pick body is angled downwardly with respect to the gripping portion 23 of the pick body at a predetermined angle "β". The angle "β" is selected such that the pick plane 29 is angularly inclined at an angle greater than about 30°, for example 35°, 55° or 80°, with respect to the gripping plane. When in use by the musician, this particular orientation of the pick portion of the pick body relative to the gripping portion provides an orientation of the pick portion of the pick body at a near right angle relative to the plane of a string being struck while maintaining a near parallel orientation between the longitudinal axis of the musician's forearm and the string.

The particularly preferred angulation which is selected may vary somewhat according to the physical characteristics of the musician, and the pick may be marketed with various angulations as desired. However, an approximate $\geqq 30°$ and $\leqq 80°$, e.g. 40-50° angulation, as described above has provided satisfactory results in commercial marketing for typical musicians or other users' use.

Figure 5:
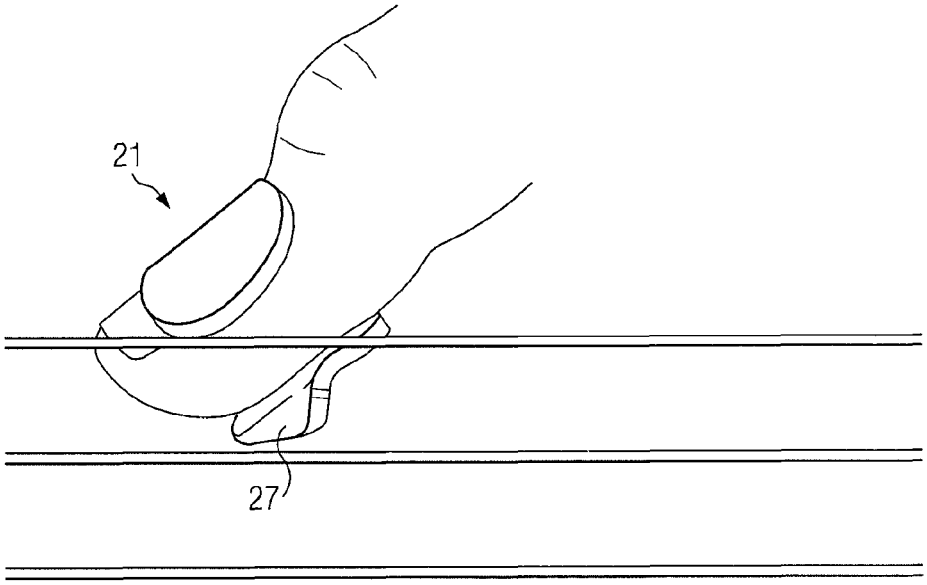
FIG. 5 is a view of the pick of FIG. 3 on a musician's thumb showing the orientation of the pick portion of the pick body relative to the strings of a musical instrument being played.
Figure 7:
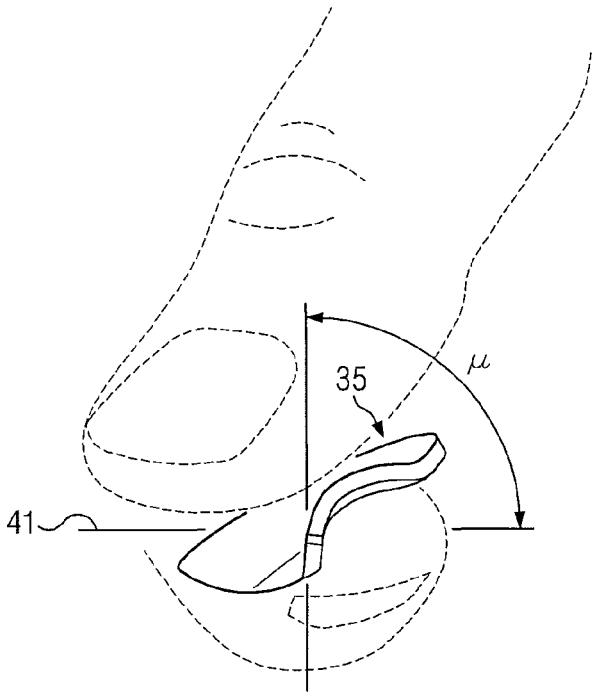
FIG. 7 is a view similar to FIG. 4, but showing the orientation of the pick portion of the flat pick of FIG. 6 relative to the string of the musical instrument being struck.
Figure 8:
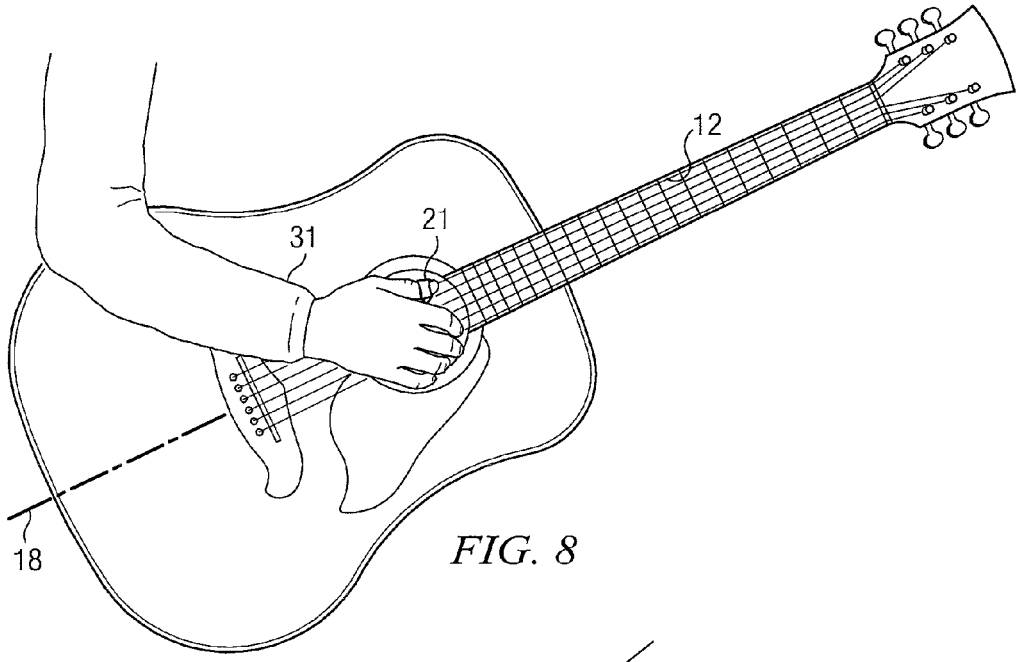
FIG. 8 is a view of a typical guitar showing the orientation of the musician's arm relative to the playing strings.
Figure 9:
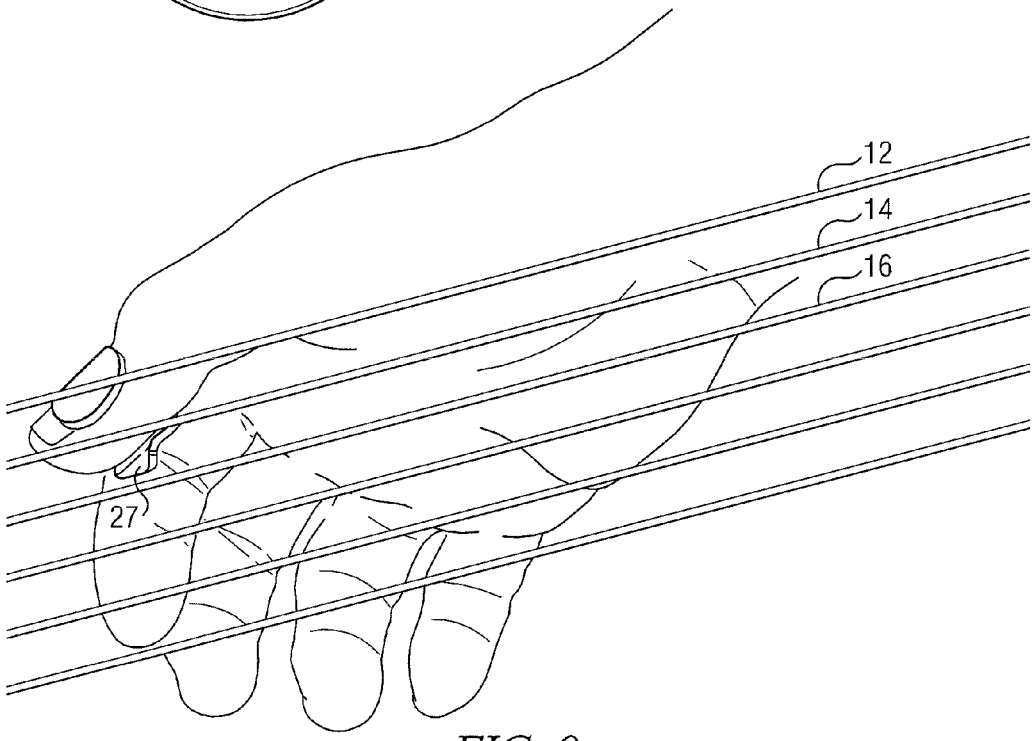
FIG. 9 is another view of the thumb pick or the invention, showing the orientation of the pick portion of the pick body in somewhat exaggerated fashion for ease of understanding.

This near perpendicular orientation of the pick portion of the pick body is illustrated in FIGS. 4, 5 and 7. FIG. 8 shows a portion of a musician's arm 31 with a pick 21 of the invention being used to play a guitar. The user is illustrated in a typical relaxed position assumed in playing the guitar with the forearm axis being typically disposed at an angle with respect to the guitar axis 18. FIG. 9 is another view of the pick of the invention with the pick portion 27 being shown in somewhat exaggerated fashion in order to emphasize the perpendicular orientation of the pick portion with respect to the plane of the guitar string.

It will also be appreciated with respect to FIG. 3, that the pick body may be viewed as having what will be referred to as an "intermediate portion" between the gripping portion 23 and the pick portion 27. The intermediate portion is illustrated as being between the dotted lines as a region 33 in FIG. 3. In other words, the elongate region of the pick body may vary in length, and wherein the length of the intermediate portion determines the degree at which the pick plane is angularly inclined relative to the gripping plane. Generally speaking, the shorter the length of the intermediate region, the smaller the angle "β" and the longer the length of the intermediate region, the greater the angle employed.

The pick body can be formed of any convenient material and typically will be formed of a synthetic, thermoplastic composition, such as a suitable thin sheet of plastic. The preferred material is a composition having deformable properties with a memory such that once deformation takes place, the pick will maintain the deformation in the proper contour. One material which has successfully been used is a relatively resilient plastic having an approximate thickness of 0.035 inches. The overall unique configuration of the pick with its novel angular orientation, may be imparted thereto by heating and twisting a thermoplastic sheet material, or in the alternative, by forming such in a mold.

Figure 6:
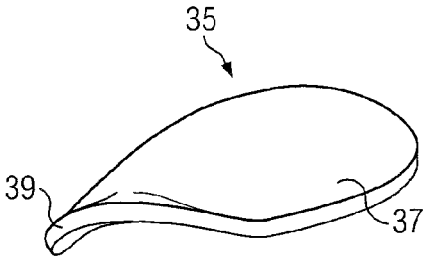
FIG. 6 is a perspective view of a flat pick which embodies the principles of the improved pick design of the invention.

While the pick design of the invention has been illustrated in FIGS. 3-4 as being a "thumb pick", it will be appreciated that the principles of design of the present invention can, as easily, be applied to a traditional flat pick, such as the flat pick shown as 35 in FIG. 6. The overall contour of the flat pick 35 shown in FIG. 6 is generally tear-drop in overall geometry, and is adapted in size to simultaneously allow a comfortable fit within the hand as well as to facilitate picking of the strings of the instrument. The flat pick 35 again has a gripping portion 37 and an outwardly extending pick portion 39 which is angularly oriented in the same manner as previously described. FIG. 7 is a partially schematic illustration of the pick 35 being used to strike the string of an instrument with the pick portion 39 striking the plane of the string (41 in FIG. 7) at a downward angle. The overall effect is such that the angle "g" is approximately perpendicular to the plane of the string, rather than being parallel to the plane of the string as in the designs of the prior art.

In use, a pick is provided as previously described with the outer extent of the pick portion of the pick body being angled downwardly with respect to the gripping portion of the pick body such that the pick plane is angularly inclined at the desired angle with respect to the gripping plane. The musical instrument is played by striking the strings with the pick with the pick portion of the pick body being approximately perpendicular to the plane of the strings and to the plane of the musician's thumb while maintaining a near parallel orientation between the longitudinal axis of the musician's thumb with the string.

An invention has been provided with several advantages. The novel orientation of the pick portion of the pick body relative to the gripping portion causes the pick portion to strike the strings of an instrument being played at a near perpendicular angle, producing a unique tonal quality to the instrument being played. At the same time, the predetermined angular orientation of the regions of the pick allow a musician to use the pick, as intended, without the necessity of cocking the wrist or assuming other uncomfortable poses. Still further, in addition to providing an improved tonal quality for certain types of music and reducing musician fatigue, the pick of the invention is more easily and positively controlled by the musician or other user, for the purposes intended. Consequently, the pick of the invention is more easily maintained at a proper orientation and pick level for optimum engagement with strings. By providing a pick with pick portions at the desired, proper angulations, the pick may be more easily and positively controlled, will be adapted to strike the strings at a proper angle for optimum tonal quality, will enable the musician to more rapidly strum the strings for certain types of music, and permits use of a natural hand motion that significantly reduces fatigue.

While the invention has been shown in one of its forms, it is not thus limited but is susceptible to various changes and modifications without departing from the spirit thereof.

What is claimed is:

1. A musician's pick comprising:

a pick body including a gripping portion lying generally within a grip plane and adapted to be gripped between the thumb and forefinger of a musician with the grip plane being generally parallel to the longitudinal axis of the musician's thumb;

a pick portion extending outwardly from the gripping portion and terminating in an outer extent which defines a pick plane, the pick portion having a predetermined length which is adapted to engage an instrument string at a predetermined depth when the gripping portion is gripped between the musician's thumb and forefinger; and, wherein the outer extent of the pick portion of the pick body is angled downwardly with respect to the gripping portion of the pick body, the outer extent of the pick portion of the pick body forming a downwardly curved lip which forms a negative angle with respect to the grip plane, such that the pick plane is angularly inclined at a negative angle greater than about 30° with respect to the gripping plane, thereby enabling orientation of the pick portion of the pick body at a near right angle relative to the plane of a string being struck while maintaining a near parallel orientation between the longitudinal axis of the musician's thumb and the string.

2. The musician's pick of claim 1, wherein the pick is formed of a thermoplastic composition.

3. The musician's pick of claim 1, wherein the pick is a thumb pick and the gripping portion of the pick body includes a ring-shaped region for at least partly encircling the thumb of the user.

4. The musician's pick of claim 1, wherein the pick is a flat pick.

5. The musician's pick of claim 1, wherein the pick portion of the pick body is angled downwardly at an angle of about 45° or greater with respect to the gripping plane of the pick body, thereby enabling orientation of the pick portion of the pick body at an angle approaching a right angle relative to the plane of the string being struck.

6. The musician's pick of claim 1, wherein the pick includes an intermediate portion between the gripping portion and the pick portion, and wherein the length of the intermediate portion determines the degree at which the pick plane is angularly inclined relative to the gripping plane.

7. A method of playing a stringed musical instrument with a musician's pick, the method comprising the steps of:

providing a pick with a pick body including a gripping portion lying generally within a grip plane and adapted to be gripped between the thumb and forefinger of a musician with the grip plane being generally parallel to the longitudinal axis of the musician's thumb;

forming a pick portion on the pick body which extends outwardly from the gripping portion and which terminates in an outer extent which defines a pick plane, the pick portion having a predetermined length which is adapted to engage an instrument string at a predetermined depth when the gripping portion is gripped between the musician's thumb;

wherein the outer extent of the pick portion of the pick body is angled downwardly with respect to the gripping portion of the pick body, the outer extent of the pick portion of the pick body forming a downwardly curved lip which forms a negative angle with respect to the grip plane, such that the pick plane is angularly inclined at a negative angle greater than about 30° with respect to the gripping plane; and playing the musical instrument by striking the strings with the pick with the pick portion of the pick body being approximately perpendicular to the plane of the strings and to the plane of the musician's thumb while maintaining a near parallel orientation between the longitudinal axis of the musician's thumb and the string.

8. The method of claim 7, wherein the pick portion of the pick body is angled downwardly at an angle of about 45° or greater with respect to the gripping plane of the pick body, thereby enabling orientation of the pick portion of the pick body at an angle approaching a right angle relative to the plane of the string being struck.

9. The method of claim 8, wherein the pick includes an intermediate portion between the gripping portion and the pick portion, and wherein the length of the intermediate portion determines the degree at which the pick plane is angularly inclined relative to the gripping plane.

* * * * *